United States Patent [19]

Kristapovich et al.

[11] 4,350,022

[45] Sep. 21, 1982

[54] REFRIGERANT TRANSFER SYSTEM

[75] Inventors: Paul J. Kristapovich; Milton E. Knapp, both of Lake Mills, Wis.

[73] Assignee: Crepaco, Inc., Lake Mills, Wis.

[21] Appl. No.: 193,168

[22] Filed: Oct. 2, 1980

[51] Int. Cl.[3] ..... F25B 41/00

[52] U.S. Cl. ..... 62/174; 62/503; 417/404

[58] Field of Search ..... 62/174, 503, DIG. 2; 417/404

[56] References Cited

U.S. PATENT DOCUMENTS

| | | | |
|---|---|---|---|
| 508,495 | 11/1893 | Whitacre | 417/404 |
| 2,371,704 | 3/1945 | Nichols | 417/404 X |
| 2,750,753 | 6/1956 | Armstrong | 417/404 |
| 2,986,898 | 6/1961 | Wood, Jr. | 62/DIG. 2 |
| 3,067,590 | 12/1962 | Wood, Jr. | 62/DIG. 2 |

*Primary Examiner*—William E. Wayner

*Attorney, Agent, or Firm*—Neuman, Williams, Anderson & Olson

[57] ABSTRACT

A refrigerant transfer system is provided embodying a pump for controlling the level of liquid refrigerant within a suction header of an evaporator unit. The pump includes a pair of elongated chambers in endwise relation. One chamber has a substantially greater cross-sectional area than the second chamber. Opposite ends of each chamber have port means. A first set of inlet and outlet valve means is connected to the port means at each end of said one chamber. Each inlet valve means is alternately connected to a source of pressurized fluid. A second set of inlet and outlet valve means is connected to the port means at each end of the second chamber. Each inlet valve means of the second set communicates with a lower portion of the evaporator suction header. The heads of a double-headed piston are disposed within the chambers. Control means are operatively connected to the first set of inlet valve means for controlling the direction of movement of the piston heads within the chambers. Each stroke of the piston head within the second chamber effects discharge therefrom of the liquid refrigerant disposed to one side of the piston head and simultaneously therewith effects inflow of the liquid refrigerant from the suction header into the portion of the second chamber disposed on the opposite side of the piston head.

8 Claims, 4 Drawing Figures

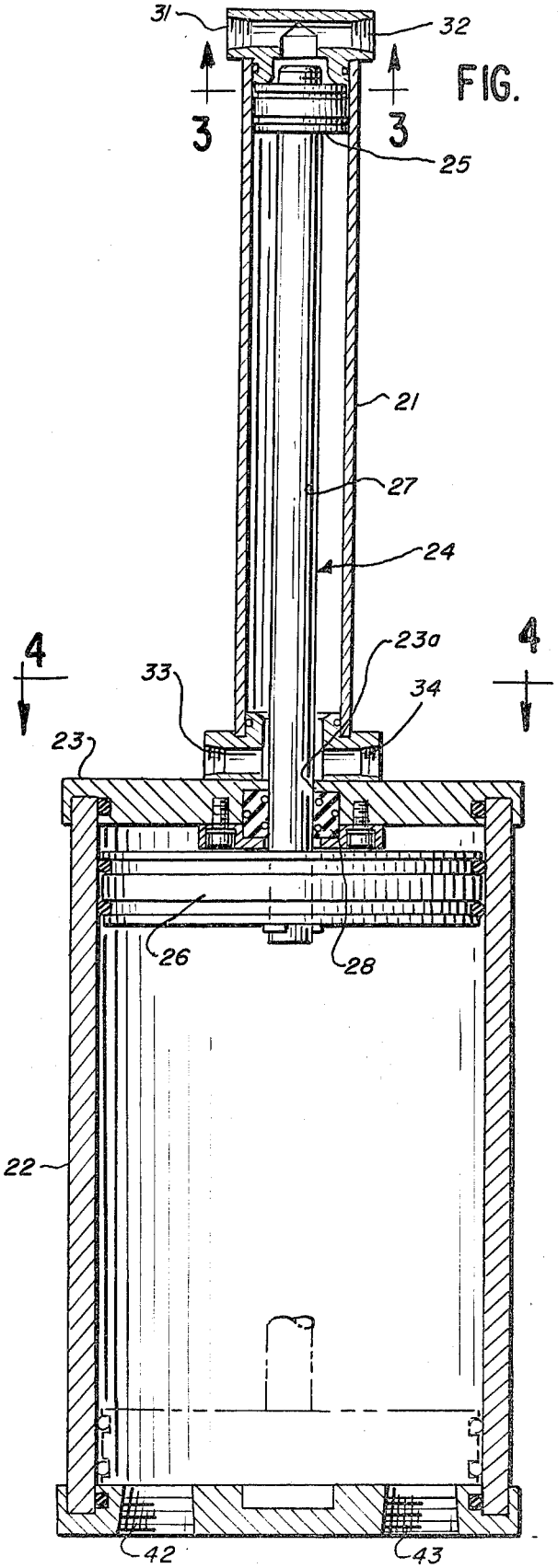
FIG. 2
FIG. 3
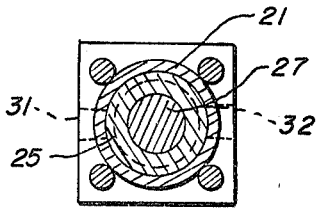
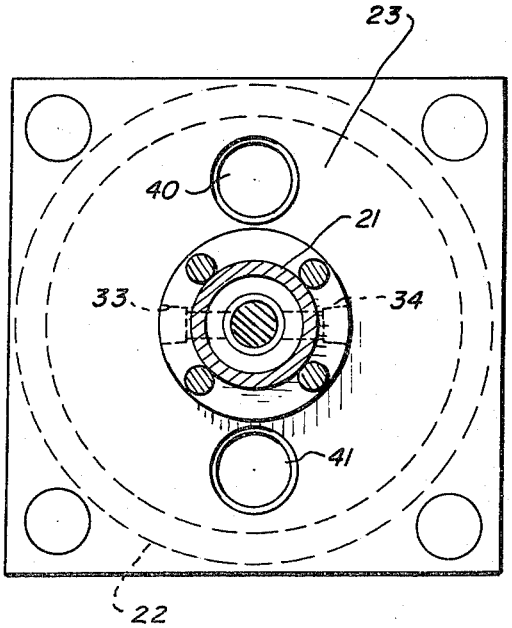
FIG. 4

REFRIGERANT TRANSFER SYSTEM

BACKGROUND OF THE INVENTION

In commercial food processing plants, refrigeration demands are oftentimes substantial and varied during processing of the food products, particularly where rapid freezing of the latter is required. Many such plants utilize one or more horizontal contact plate freezer units, each having from ten to thirty plates or refrigerant evaporators between which the product passes during the freezing cycle. U.S. Pat. No. 2,882,697 discloses one type freezer commonly utilized in such plants.

Each plate is subjected to a different refrigeration load which varies depending upon the relative position of the plate within the unit at a given period during the freezing cycle. For example, at the time the warm, unfrozen product enters the freezer unit and is disposed between a pair of contact plates, a large refrigeration load (e.g., 3–6 tons) is imposed on the plates. At the same time certain of the other loaded plates within the unit may be near the end of their respective freezing cycle with the result that the refrigeration load imposed thereon is minimal (e.g., 0–1 ton). As a result of this refrigeration load demand differential, effective and proper control of the refrigeration feed to the various unit plates becomes a difficult and complex problem. In order to circumvent this control problem, many users of contact plate freezers have pumped liquid refrigerant within the system so as to provide an overfeed of approximately eleven or twelve to one (11–12 to 1) with respect to the average refrigerant requirement for the entire system. Because of this overfeed condition, serious problems have developed in that substantial static heads of the liquid refrigerant have resulted in the suction header incorporated in the system. Such heads may seriously impair the operating efficiency of the system. The problem oftentimes is enhanced where the plant in which the system is installed is a single floor structure.

In an effort to alleviate this problem, one or more of the following approaches have been attempted: (a) providing gravity drainage of the liquid refrigerant from the header into a deep, large capacity, recessed collection pit or reservoir and then utilizing a conventional pump to transfer the accumulated liquid refrigerant to an overhead suction main; (b) providing gravity drainage into small capacity on-floor accumulators and then alternately emptying such accumulators by the imposition of high-pressure vapor obtained from the high side of the refrigeration system; and (c) in place of a liquid refrigerant such as ammonia, which has a high latent heat value, circulating at an excess overfeed rate (e.g., one hundred to one) live brine.

It has been found, however, that each of these approaches is beset with one or more of the following shortcomings: (1) the operating efficiency of the system is extremely low; (2) the initial costs for the equipment and installation thereof are inordinately high; (3) the maintenance and service costs of the various components of the system are also inordinately high; (4) a wide variety of freezer types cannot be readily incorporated in the system; and (5) substantial floor space is required to accommodate the system components.

SUMMARY OF THE INVENTION

Thus, it is an object of the invention to provide an improved refrigerant transfer system which avoids the aforenoted shortcomings.

It is a further object to provide an improved refrigerant transfer system which embodies a highly efficient, slow-speed, non-cavitating pump for circulating the liquid refrigerant from the suction header to an accumulator or directly to the suction main and wherein the power source for the pump is obtained from the potential energy within the refrigeration system itself.

It is a further object to provide an improved refrigerant transfer system wherein the operation thereof does not impose any additional tare load on the system compressor.

It is a still further object to provide an improved refrigerant transfer system embodying a pump for the liquid refrigerant wherein conventional external pump seals are not required.

It is a still further object to provide a double-headed liquid refrigerant pump in an evaporator system wherein any potential leakage between the two contiguous cylinders of the pump is self-contained within the pump itself.

It is an additional object to provide a pump which may be readly utilized in a variety of refrigeration systems embodying either contact plate freezers, floor-mounted cold diffusers, ice builders, brine tanks, sheet and tube exchangers, plate heat exchangers, or the like.

Further and additional objects will appear from the description, accompanying drawings, and appended claims.

In accordance with one embodiment of the invention, a refrigerant transfer system is provided which utilizes a double-headed pump for a liquid refrigerant to control the level of the liquid refrigerant which accumulates within the suction header of an evaporator unit. The pump includes a pair of cylindrical chambers arranged in contiguous end-to-end relation. One of the chambers has substantially smaller cross-sectional area than the second chamber. Both chambers have the opposite ends thereof provided with port means. A double-headed piston is provided having a first head slidably disposed within the one chamber, and a second head slidably disposed within the second chamber. The heads are interconnected so as to move as a unit. A first set of inlet and outlet valve means is connected to the port means at each end of the one chamber. Each inlet valve means is connected to a source of pressurized fluid. A second set of inlet and outlet valve means is connected to the port means at each end of the second chamber. Each inlet valve means of the second set is connected to a lower portion of the suction header and below the level of the liquid refrigerant accumulated therein. Control means are associated with the first set of inlet and outlet valve means for alternately operating the latter, whereby the inlet valve means at one end of the one chamber, and the outlet valve means at the opposite end of the one chamber are simultaneously opened to effect movement of the piston first head within the one chamber by the pressurized fluid. For each stroke of the piston, liquid refrigerant flows from the suction header into the portion of the second chamber disposed to one side of the piston second head and simultaneously flows out of the portion of the second chamber disposed on the opposite side of the piston second head.

DESCRIPTION

For a more complete understanding of the invention reference should be made to the drawings wherein:

FIG. 2 is an enlarged fragmentary vertical sectional view of one form of the double-headed pump for liquid refrigerant embodied in the system of FIG. 1.

Figure 1:
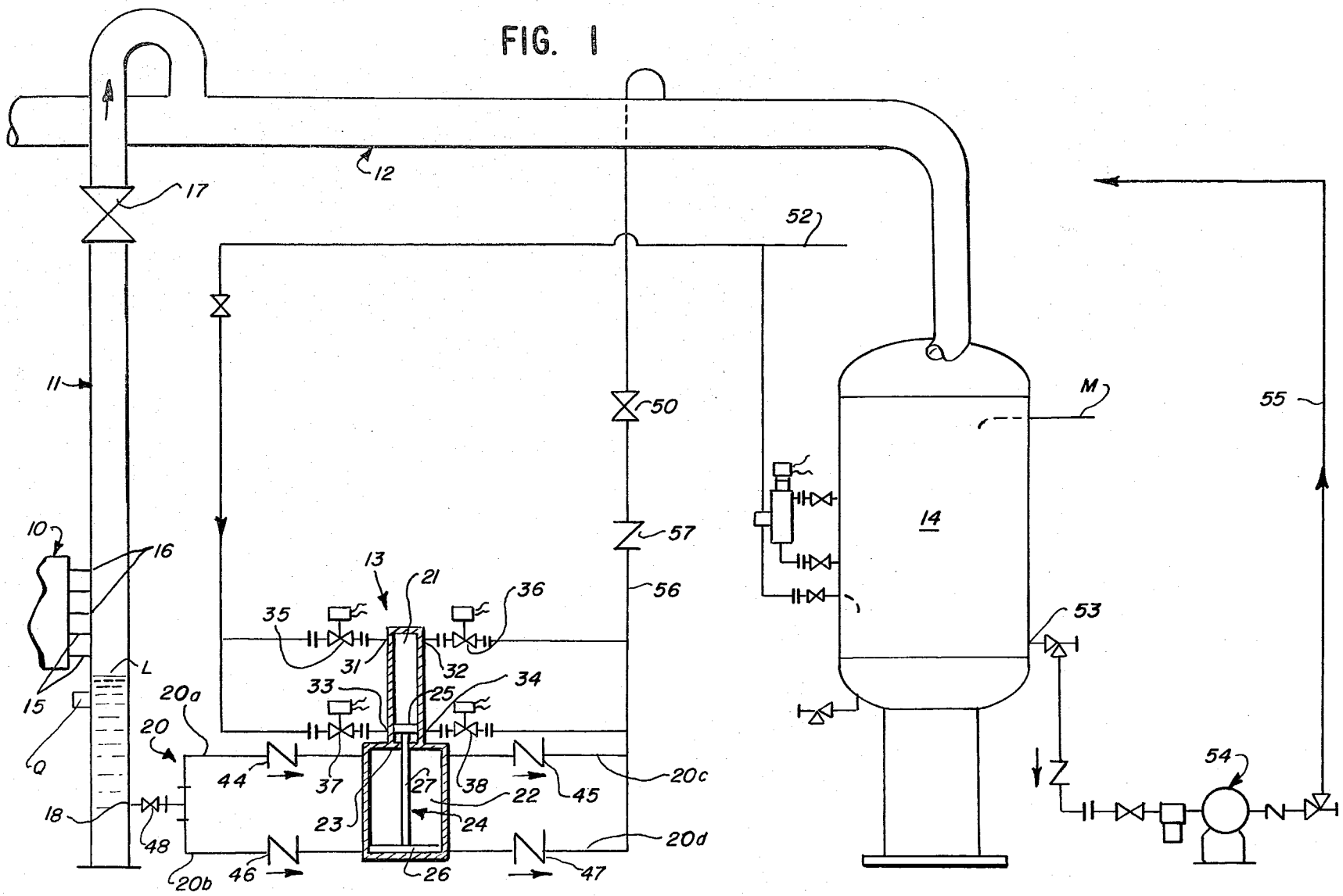
FIG. 1 is a diagrammatic view of one form of the improved refrigerant transfer system.

FIGS. 3 and 4 are enlarged fragmentary sectional views taken along lines 3—3 and 4—4 respectively of FIG. 2.

Referring now to the drawings and more particularly to FIG. 1, one form of an improved refrigerant transfer system is shown which includes an evaporator unit 10 (e.g., contact plate freezer); a suction header 11 connected to the unit 10; a suction main 12 elevated relative to the header 11 and connected to the upper end thereof; a double-headed pump 13; and a liquid refrigerant accumulator 14.

For purposes of facilitating understanding of the improved refrigerant transfer system, the evaporator unit 10 will be described as a horizontal contact plate freezer which normally consists of a plurality of adjustable freezer plates (e.g., 10 to 30 in number) arranged in stacked parallel superposed relation. Typical of such a freezer is that disclosed in U.S. Pat. No. 2,882,697. The stack of plates is disposed within a housing or casing having wide inlet and outlet openings arranged opposite one another and in a horizontal plane. The stack of plates moves vertically in a controlled manner within the housing so that pairs of plates are successively positioned, in a predetermined timed sequence, adjacent the housing openings whereupon each pair of positioned plates are moved apart so that the spacing therebetween is aligned with the openings. With the spaced apart plates so disposed, loading and/or unloading thereof can occur. Once the lower of the pair of plates is loaded with unfrozen products, the plates are then adjusted so that the products disposed therebetween are engaged top and bottom by the surfaces of the plates. The time to complete the freezing cycle will depend upon the characteristics of the products involved, the freezing capacity of the plates, and many other variables which are predetermined. As a result of the loading and unloading procedures involved and operation of the contact plate freezer, the refrigeration load demands for the plates within the housing at any given period of time may vary over a wide range (e.g., 3–6 tons at the beginning of the refrigeration cycle, and 0–1 tons at the end of the cycle). In lieu of utilizing complex and costly devices to regulate the amounts of liquid refrigerant fed to the various freezer plates, it has been customary to pump liquid refrigerant to the plates so as to provide an overfeed of approximately eleven or twelve to one relative to the average requirement of the entire system.

Because a vast majority of all commercial food freezing and processing plants are a single floor operation, the handling of the excess liquid refrigerant has heretofore been a costly and perplexing problem. Unless the excess liquid refrigerant is properly handled, it will accumulate in the upright suction header 11 and produce an undesirable static head which inhibits the flow of vapor from the suction header 11 into the suction main 12. The function and operation of a contact plate freezer are well known in the art and form no part of the present invention.

As noted in FIG. 1, the liquid and vaporous refrigerant flows from unit 10 through suitable piping 15 to a first connection 16 provided on the header 11. The connection 16 is elevated a substantial distance relative to the bottom of the header. A service valve 17 is provided between the upper end of header 11 and suction main 12. In the normal operating mode, valve 17 is usually fully opened as it is the intent for rapid freezing to have the temperature of the contact plates 10 to be as cold as possible. The suction main 12 is connected to the low pressure accumulator 14 which in turn is connected by main M to the refrigeration compression-condensing system, not shown.

The header 11 is provided with a second connection 18 which is disposed adjacent the bottom of th header and is a substantial distance beneath the first connection 16. Extending from connection 18 is a piping arrangement 20 which will be described more fully hereinafter. A level control sensing device Q may be provided on header 11 beneath connections 16.

Pump 13, as seen more clearly in FIGS. 2–4, is provided with two cylindrical chambers 21, 22 which are arranged in substantially end-to-end relation and are separated from one another by a common partition 23. The cross-sectional area of chamber 22 is substantially greater than that of chamber 21 (e.g., sixteen to one) and therefore the volume ratio of chamber 22 to chamber 21 may be about sixteen to one (16 to 1). Mounted for reciprocatory movement within the chambers 21, 22 is a double-headed piston 24. Heads 25, 26 of piston 24 are disposed within chambers 21 and 22 respectively and are interconnected by a rod 27. The rod 27 is slidably disposed within an opening **23*a* formed in partition 23. Located within the opening 23*a* is a bushing 28**.

Formed at each end of chamber 21 is a pair of ports 31, 32 and 33, 34 to which are connected first sets of inlet and outlet valves 35, 36 and 37, 38. The function and operation of the valves will be discussed more fully hereinafter.

Chamber 22 is also provided with ports 40, 41 and 42, 43, see FIGS. 2 and 4, which are disposed at opposite ends thereof. Associated with the ports are second sets of inlet and outlet valves 44, 45 and 46, 47. Valves 44, 46 are check valves and permit flow of the liquid refrigerant in only one direction from the header 11 through connection 18, a service valve 48 and then through one of two branch sections **20*a*, 20*b* of the piping arrangement 20, depending upon the stroke of the piston head 26 within chamber 22**.

Valves 45, 47 are likewise check valves which are disposed within branch sections **20*c*, 20*d* of the piping arrangement 20. Valves 45, 47 permit flow of the liquid refrigerant from the chamber 22 through a pipe section 56, check valve 57 and service valve 50 into suction main 12**.

The accumulator 14 is of conventional design and is usually provided with a refrigerant make-up or float valve which is associated with a pipe section 52. This float valve controls the amount of liquid refrigerant needed to replensih the system.

A discharge port 53 is provided in the lower part of the accumulator through which liquid refrigerant is removed from the accumulator by a conventional pump 54 and is directed to the evaporator unit 10 through a pipe section 55.

As aforementioned, the movement of the piston head 25 within cylinder chamber 21 is effected by pressurized fluid which is alternately introduced into the chamber 21 through ports 31, 33 subsequent to passing through control valves 35, 37. Alternating flow of the pressurized fluid from chamber 21 out through ports 32, 34 is effected by control valves 36, 38.

Each of the valves 35–38 is controlled by a solenoid, the operation of which is pre-programmed or time-controlled from a remote control panel, not shown. During operation of the pump, the inlet valve 35 or 37 connected to one end of chamber 21 is simultaneously opened with the outlet valve 38 or 36 connected to the opposite end of the chamber, thereby effecting movement of piston head 25 either towards or away from chamber 22.

As aforenoted, the operation of the solenoid valves 35–38 is pre-programmed or time-controlled and they are responsive to an impulse from the sensing device Q so that only a predetermined amount of liquid refrigerant will be permitted to accummulate within the header 11 and thus, not adversely affect the flow of vaporous refrigerant from header 11 to the suction main 12.

As seen in FIG. 1, the downstream sides of outlet valves 36, 38, 45, and 47 are interconnected by piping 56. Flow through piping 56 is through check valve 57 and service valve 50 to suction main 12.

Pump 13 is slow acting and thus, maintains a predetermined level L of liquid refrigerant within header 11 so as not to interface with the vapor flow to the suction main 12 and yet, at the same time ensures that cavitation will not occur within chamber 22 of pump 13.

The pressurized fluid utilized to effect movement of piston head 25 within chamber 21 is preferably obtained from the pressure normally maintained in a typical refrigeration system. Where evaporator unit 10 is a contact plate freezer, the condensing pressure is normally at 150 p.s.i.g. or higher. In FIG. 1 this pressurized fluid is obtained from the compression-condensing system through line or pipe section 52. The suction main 12 is normally at zero (0) or at a vacuum. The maximum static head encountered in piping 56 is normally 7.5 p.s.i.g. or less. Therefore, there is a power relationship of driving piston head 25 to the driven piston head 26 of about twenty to one (20 to 1). Thus, there is sufficient driving power to offset the volumetric relationship of approximately sixteen to one (16 to 1) of chamber 22 to chamber 21.

In the illustrated embodiment the chambers 21, 22 of pump 13 are diagrammatically shown in vertically aligned contiguous relation and are separated from one another by the common partition 23. If desired, however, the chambers, while arranged in end-to-end relation, may be disposed in a non-vertical alignment. The partition opening 23*a* through which the rod 27 slidably extends is disposed within the interior of the pump housing and thus, any leakage which might occur in the vicinity of the opening will be self-contained within the pump.

Thus, it will be observed that an improved pump for liquid refrigerant and a refrigeration system embodying same has been provided which effectively overcome the serious problems caused by a static head of liquid refrigerant developing within the suction header. Furthermore, the condensing pressure within the system is utilized to operate the pump and thus, no additional tare load is imposed on the system because the refrigerant required to operate the pump 13 is less than the system requirement that is normally needed as make-up through the float feed valve associated with line 52. Because of the effective control of the level of the liquid refrigerant within the suction header, the overall efficiency of the refrigerant transfer system is markedly improved and the overfeed rate of the liquid refrigerant can be significantly reduced to approximately six to one (6 to 1).

The size and configuration of the various components comprising the improved refrigerant transfer system may vary from that hereto described and will depend upon the refrigeration load demands required.

We claim:

1. In a refrigeration system utilizing a pumped liquid refrigerant, a combination comprising a substantially upright suction header having a first connection to an evaporator unit; a suction main elevated relative to said header and connected to an upper end portion thereof; a pump for liquid refrigerant including a pair of elongated chambers arranged in substantially end-to-end relation and separated from one another by a common partition, one chamber having a substantially smaller cross-sectional area than the second chamber, each chamber having the opposite ends thereof provided with port means, and piston means reciprocally mounted within said chambers, said piston means having a first head slidably disposed within said one chamber and a second head slidably disposed within said second chamber, said second head having a substantially greater diameter than said first head, said heads being interconnected by means extending through said common partition whereby said heads are movable as a unit; first sets of inlet and outlet valve means connected to the port means at each end of said one chamber, each inlet valve means communicating with a source of high pressure fluid; control means operatively connected to said first sets of valve means wherein alternately an inlet valve means at one end of said one chamber and an outlet valve means at the opposite end of said one chamber open and close simultaneously; a second set of inlet and outlet valve means connected to the port means at each end of the second chamber, each inlet valve means of the second set communicating with a second connection provided in said header and spaced beneath said first connection whereby liquid refrigerant accumulated in said header is adapted to flow only in one direction through one inlet valve means of the second set into a portion of the second chamber disposed to one side of the piston means second head and simultaneously flow outwardly from the other portion of the second chamber disposed to the opposite side of the piston means second head for each stroke of the latter within the second chamber, each outlet valve of the second set communicating with said suction main and permitting liquid refrigerant flow in only one direction from said second chamber to said suction main.

2. The combination of claim 1 wherein the second chamber subtends said one chamber.

3. The combination of claim 1 wherein the volume ratio of the one chamber to the second chamber is in the range of about 1 to 10 to about 1 to 20.

4. The combination of claim 3 wherein the power ratio of the piston means first head to the piston means second head is about 20 to 1.

5. The combination of claim 1 wherein the pressure of the pressurized fluid entering said one chamber is about 150 p.s.i.g. and the pressure of the liquid refrigerant leaving the second chamber is about 7 p.s.i.g.

6. The combination of claim 1 wherein the high pressure fluid discharged from the one chamber and the liquid refrigerant discharged from the second chamber are adapted to flow into a low pressure accumulator.

7. The combination of claim 1 wherein the operation of said control means is regulated by a sensing means for maintaining a predetermined level of liquid refrigerant accumulated within said suction header.

8. The combination of claim 1 wherein the pressurized fluid includes a portion of the high pressure refrigerant within the refrigeration system.

* * * * *

UNITED STATES PATENT AND TRADEMARK OFFICE

CERTIFICATE OF CORRECTION

PATENT NO. : 4,350,022

DATED : September 21, 1982

INVENTOR(S) : Paul J. Kristapovich; Milton E. Knapp

It is certified that error appears in the above-identified patent and that said Letters Patent are hereby corrected as shown below:

Column 4, line 15 - "th" should be --the--

Column 4, line 60 - "replensih" should be --replenish--

Column 5, line 27 - "interface" should be --interfere--

Signed and Sealed this

*Nineteenth* Day of *April 1983*

[SEAL]

*Attest:*

GERALD J. MOSSINGHOFF

*Attesting Officer*

*Commissioner of Patents and Trademarks*